United States Patent [19]

Colin

[11] 4,031,843

[45] June 28, 1977

[54] DEVICE FOR CONNECTING A BARGE AND A PUSHER

[75] Inventor: Jean-Paul Colin, Loire-Atlantique, France

[73] Assignee: Ateliers et Chantiers de Bretagne – A.C.B., Loire-Atlantique, France

[22] Filed: Jan. 9, 1975

[21] Appl. No.: 539,831

Related U.S. Application Data

[63] Continuation-in-part of Ser. No. 385,577, Aug. 3, 1973, abandoned, which is a continuation of Ser. No. 575,234, May 7, 1975.

[30] Foreign Application Priority Data

| | | |
|---|---|---|
| Aug. 9, 1972 | France | 72.28708 |
| Jan. 16, 1974 | France | 74.01415 |

[52] U.S. Cl. ..... 114/247

[51] Int. Cl.[2] ..... B63B 21/56; B63B 35/70

[58] Field of Search ..... 114/235 R, 235 A, 219, 114/77 R

[56] References Cited

UNITED STATES PATENTS

| | | | |
|---|---|---|---|
| 3,362,372 | 1/1968 | Peterson | 114/235 R |
| 3,492,964 | 2/1970 | Garcia | 114/235 R |
| 3,844,245 | 10/1974 | Yamaguchi | 114/235 R |
| 3,878,806 | 4/1975 | Garcia | 114/77 R |

*Primary Examiner*—Trygve M. Blix
*Assistant Examiner*—Gregory W. O'Connor
*Attorney, Agent, or Firm*—Stevens, Davis, Miller & Mosher

[57] ABSTRACT

A pusher tug and barge in combination joined rigidly yet separately in tandem to form a single pusher type seagoing unit in which the two vessels are interconnected via hydraulic compression members combined with pressure accumulators.

3 Claims, 6 Drawing Figures

FIG. 5
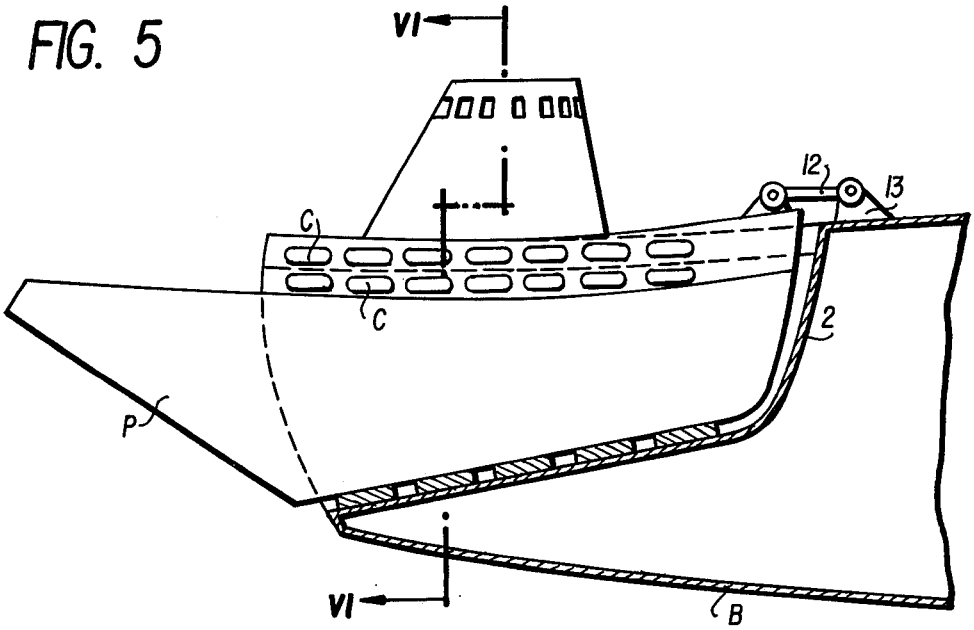
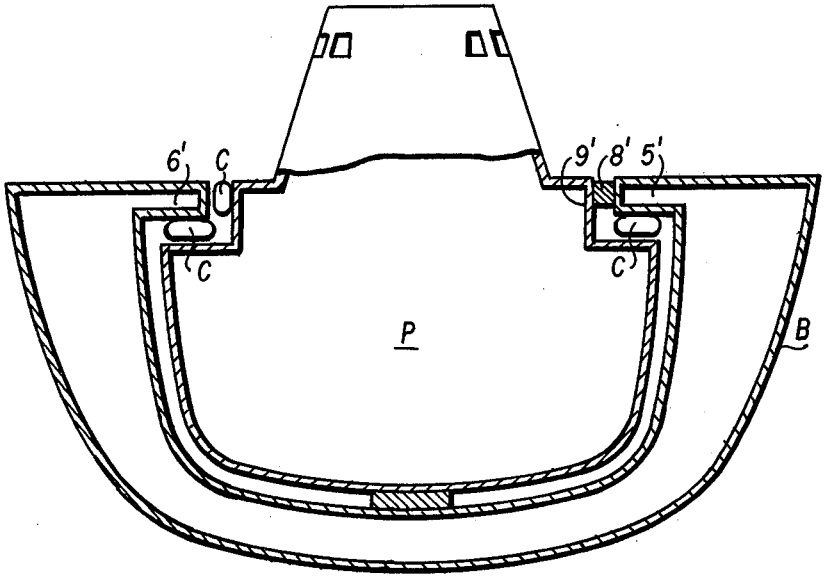
FIG. 6

DEVICE FOR CONNECTING A BARGE AND A PUSHER

This application is a continuation-in-part of my copending application No. 385,577, filed on Aug. 3, 1973, now abandoned in favor of continuation application No. 575,234 filed May 7, 1975.

The parent application relates to a device for connecting a barge and a pusher, wherein the after part of the barge is formed with a substantially inverted T-shaped groove into which the forward part of the pusher can adapt itself with clearance, the two vessels being interconnectable on the one hand by means of a thrust-transmitting member which can take the form of a simple connecting rod, and on the other by the pusher hull in the groove in the barge by means of planes whose level can be varied, for instance, by means of inflatable cushions or jacks interposed between the barge and the pusher.

Such cushions or jacks are as a rule inflated by means of liquid such as oil or water; this has the disadvantage of requiring a relatively considerable initial prestressing if contact between the barge and the pusher is not to be lost when the assembled vessels are at sea.

It is the main object of the present invention to obviate this disadvantage; to this end the cushions or similar hydraulic compression members are combined with pressure accumulators containing a compressed gas.

At low pressure variations in the volume of the gas enclosed in the accumulator are considerable, for a small variation of volume in the cushion. The low pressure rigidity is therefore slight. In contrast, at high pressure the variations in the volume of the gas are low for large differences in pressure and in that case there is considerable rigidity. A relatively slight initial tension therefore prevents the barge and pusher from losing contact with one another.

Figure 1:
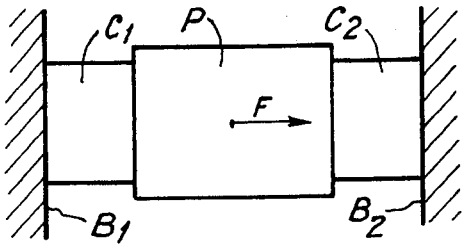
Figure 2:
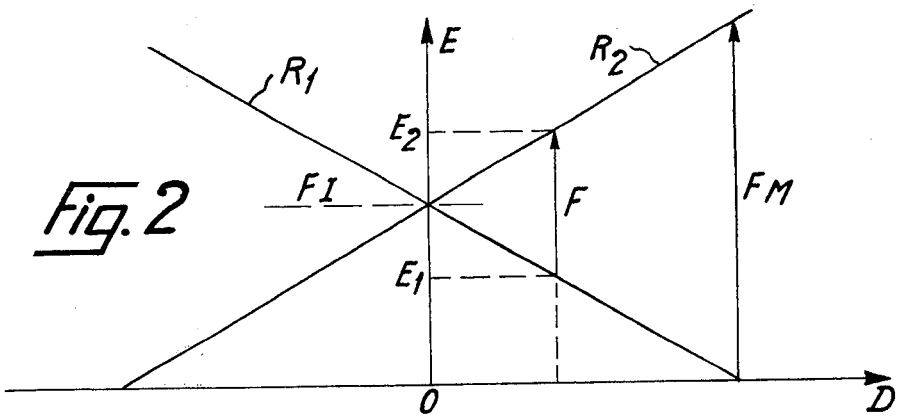
Figure 3:
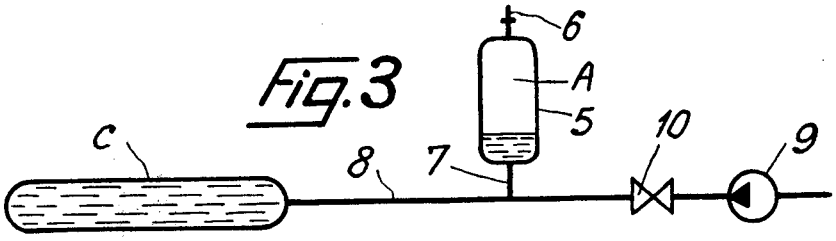
Figure 4:
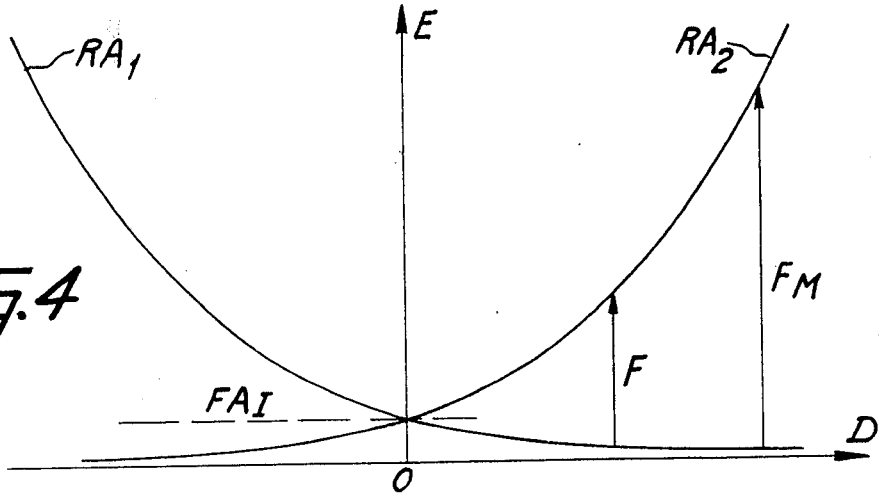

The invention will be clearly understood from the following description of a non-limitative embodiment thereof, with reference to the accompanying drawings, wherein:

FIG. 1 is a diagram illustrating how a pusher can be jammed into the groove of a barge by means of hydraulic compression members, such as inflatable cushions, FIG. 2 is a graph showing the rigidity of the cushions or similar hydraulic compression members, FIG. 3 illustrates diagrammatically the mounting of a cushion and a pressure accumulator with which the cushion is combined, FIG. 4 is a view which is similar to FIG. 1 but shows the rigidity of the compressive member combined with pressure accumulators, FIG. 5 is a diagrammatic longitudinal section of an assembly formed by an interconnected barge and pusher tug, and FIG. 6 is a sectional end elevation along line VI—VI of FIG. 5.

Referring to FIG. 1, the pusher P, shown diagrammatically in the form of a rectangle, is compressed between two walls $B_1$, $B_2$ of a barge by expansible means in the form of hydraulic members, such as inflatable cushions $C_1$, $C_2$. The cushions can be formed by bladders of rubber or some similar elastomer, if necessary suitably reinforced, for instance, by steel wires or cables. The cushions generally have the shape of a rectangular parallelepiped. The two cushions $C_1$, $C_2$ are identical and initially inflated at the same pressure.

Their rigidity is shown in FIG. 2 in which the displacements D of the pusher perpendicular to the walls $B_1$, $B_2$ are plotted on the abscissa, and the forces E exerted on the pusher are plotted on the ordinate axis. The rigidity of each of the cushions $C_1$, $C_2$ are represented by straight lines $R_1$, $R_2$ respectively symmetrical in relation to the straight line OE corresponding to the mean position of the pusher. In this case each of the cushions exerts an identical force $F_1$, which is the initial prestressing, on the pusher. If a force F is exerted on the pusher, for instance, in the direction of $B_2$, the cushion $C_2$ will be compressed and a cushion $C_1$ relieved. The forces exerted by the cushions will be equal to $E_1$, $E_2$, as indicated in FIG. 2 with $E_2 - E_1 = F$.

When the value of F reaches twice the initial prestressing, the force exerted by the cushion $C_1$ on the pusher is cancelled out, and if F increases beyond such maximum value $FM = 2F_1$, contact is lost between the barge and pusher and therefore F diminishes as shock will take place, and this must be avoided.

To this end, as shown diagrammatically in FIG. 3, each of the cushions C, or if necessary a number of cushions acting and supplied in parallel, is combined with a pressure accumulator A formed by an enclosure 5 having a valve 6 by means of which a predetermined quantity of a gas such as air can be introduced. The enclosure A is connected via a conduit 7 to a passage 8 connecting the cushion C to pump 9, which supplies the liquid to inflate the cushion. This connection is made downstream of a tap 10 for keeping the cushion inflated or deflating it.

The rigidities $RA_1$ and $RA_2$ of the cushions $C_1$, $C_2$, combined with their accumulator, are shown in FIG. 4. The rigidities are no longer represented by straight lines, but by curves of hyperbolic outline whose slope is very slight for low forces.

At low pressure the volume of gas contained in the accumulator A is relatively considerable, and the variations in volume of the gas are great for a slight variation at low pressure. In contrast, at high pressures the variations in the volume of the gas are low for considerable differences in pressure, in which case there is considerable rigidity.

As can be seen from FIG. 4, for an identical maximum force FM, the initial prestressing FAI which must be given to the cushions is much lower than in the case of FIG. 2, and moreover the risks of loss of contact are obviated as a result of the radial pressure of the gas in the accumulator which prevents the thrust from being cancelled out.

Various advantages result from this; The reduction in the initial prestressing results in a reduction of the forces exerted on the structures when at rest — i.e., when the assembly formed by the pusher and the barge is sailing over a calm sea; the mean value of the forces is lower, so that the materials experience less fatigue, and the structures can be lightened for an equal life;

By altering the characteristics of the accumulators, for instance, modifying the pressure at rest, the pusher can be better adapted to the barge. The frequency of the system can also be changed, thus preventing the occurence of resonance with the vibrations of the vessel;

The security of the contact between the pusher and the barge enables the connecting rod device to be lightened and the stability of the pusher increased.

As shown in FIGS. 5 and 6, the stern of the barge B is formed with a longitudinal groove 2 of substantially inverted T-shaped section to which the bow of the pusher tug can adapt itself with a clearance. The upper part of the groove 2 forms two longitudinal edges 5', 6' against which the tops of the sides of the hull of the pusher tug bear.

The lateral edge 5' has undersurfaces beneath which inflatable cushions C bear which are borne by the top of the starboard side of the pusher tug and lateral platings 8' against which matching surfaces 9' with which the pusher tug is formed bear. The longitudinal edge 6' is adapted to cooperate with two series of inflatable cushions C with which the tug is equipped.

To keep the barge B and pusher tug P interconnected and assembled together, a thrust-transmitting member in the form of a connecting rod 12 borne by the pusher tug P is connected to a lug 13 disposed on the barge B forward of the longitudinal groove 2. The connecting rod 12 transmits the thrust forces but is not subjected to any component of the forces substantially at right angles to the longitudinal axis of the combined barge and pusher tug.

I claim:

1. In a system for interconnecting a barge and a pusher tug, having the stern of the barge complementary with the bow of the pusher tug, a longitudinal groove in the stern part of the barge, said groove having a section of substantially inverted T form in transverse cross-section to which the bow of said pusher tug conforms with clearance when the tug and the barge are brought together, a rigid thrust transmitting passive member attached at one end to said pusher tug and at the other end to the stern of said barge so as to transmit longitudinal forces and not forces at right angles to the longitudinal axis of the combined barge and pusher tug, expansible hydraulic compression members in the groove for interconnecting said bow and said stern, a pressure accumulator in fluid communication with said members, and means for expanding said expansible members after the tug and the barge have been interconnected by said thrust transmitting member.

2. A system according to claim 1, characterised in that the pressure accumulator comprises an enclosure which communicates with a conduit supplying liquid to the expansible members and in which a predetermined quantity of a gas is stored.

3. A system according to claim 2 wherein the expansible members are inflatable cushions interposed in the clearance between the barge and the tug.

* * * * *